United States Patent [19]

Hasler et al.

[11] Patent Number: 4,548,902

[45] Date of Patent: Oct. 22, 1985

[54] METHOD FOR DETERMINING THE COMPATIBILITY OF A DIRECT OR REACTIVE DYESTUFF WITH A POLYBASIC AMINO COMPOUND

[75] Inventors: Rolf Hasler, Oberwil, Switzerland; Francis Palacin, Riedisheim, France

[73] Assignee: Sandoz Ltd., Basel, Switzerland

[21] Appl. No.: 499,991

[22] Filed: Jun. 1, 1983

Related U.S. Application Data

[63] Continuation of Ser. No. 347,137, Feb. 9, 1982, abandoned.

[30] Foreign Application Priority Data

Feb. 14, 1981 [DE] Fed. Rep. of Germany ..... 3105405

[51] Int. Cl.[4] ..... G01N 21/82; G01N 31/02

[52] U.S. Cl. ..... 436/2; 8/496; 8/543; 8/551; 436/164; 436/183

[58] Field of Search ..... 436/106, 112, 2, 164, 436/183; 8/496, 551, 543, 181 A

[56] References Cited

U.S. PATENT DOCUMENTS 2,214,067 9/1940 Petersen ..... 8/551

3,301,696 1/1967 Taube et al. ..... 8/496

4,410,652 10/1983 Robinson et al. ..... 524/195

OTHER PUBLICATIONS

Dupont Technical Bulletin on Dyes and Chemicals, vol. 20, No. 1, Jun. 1964, p. 67.

*Primary Examiner*—Hiram H. Bernstein
*Assistant Examiner*—Robert J. Hill, Jr.
*Attorney, Agent, or Firm*—Gerald D. Sharkin; Richard E. Vila; Thomas C. Doyle

[57] ABSTRACT

Dyeings on cellulose with direct or reactive dyestuffs are given improved wet fastness properties by aftertreatment with a reaction product or mixture of a polybasic amino compound (A) with an N-methylol compound (B) or with formaldehyde or a formaldehyde donor and optionally a crosslinking catalyst (C). Particular direct or reactive dyestuffs and polybasic amino compounds are determined to be suitable in the dyeing and aftertreatment when the dyestuff and the polybasic amino compound (A) are such that when mixed together in aqueous solution they give a precipitate which, after washing and drying does not redissolve in aqueous alkali at pH $\geqq$ 12 at room temperature.

18 Claims, No Drawings

METHOD FOR DETERMINING THE COMPATIBILITY OF A DIRECT OR REACTIVE DYESTUFF WITH A POLYBASIC AMINO COMPOUND

This is a continuation of application Ser. No. 347,137, filed Feb. 9, 1982, now abandoned.

This invention relates to a textile treatment process for improving the wet fastness of direct or reactive dyes on cellulose-containing substrates.

Dyeings and printings with direct dyestuffs often show inadequate wash fastness. The dyestuff which is bound to the surface of the cellulose fibres is largely removed from the fibres by repeated washings, and bleeding of the dyestuff into the wash liquid can cause partial readsorption onto undyed cellulose material.

There have been many attempts to overcome these disadvantages, for example by complexing on the fibre with metal salts, formation of the dyestuff on the fibre, treatment of the dyestuff and/or the fibre with formaldehyde, impregnation with artificial resins and after-treatment with cationic auxiliaries. The use of cationic after-treatment auxiliaries has proved particularly effective.

The disadvantage of all previously used methods is that although improved fastness is indeed attained, the results are only temporary. Even in the case of cationic after-treatment, the auxiliary is removed from the fibres by repeated washings, particularly under alkaline conditions and at high temperatures such as 50°-100° C. The loss of the cationic auxiliary means that the dyeing loses its improved wet fastness again.

Reactive dyes attempt to solve the problem of wash fastness by the formation of a chemical bond between the dye molecule and the cellulose fibre. However, a disadvantage of the use of reactive dyes is that although the dyestuff which is chemically bound to the fibre has excellent wash fastness, the goods must be washed thoroughly after dyeing in order to remove residual unfixed dyestuff, which has poor wash fastness.

The present invention provides a process for improving the wet-fastness properties of a direct or reactive dyestuff on a substrate comprising cellulose fibres comprising the step of applying to the dyed or printed substrate an aftertreatment agent which is a reaction product or mixture of a polybasic amino compound (A) with an N-methylol compound (B) or with formaldehyde or a formaldehyde donor and optionally a crosslinking catalyst (C), the dyestuff and the polybasic amino compound (A) being such that when mixed together in aqueous solution they give a precipitate which, after washing and drying does not redissolve in aqueous alkali alkali at pH≧12 at room temperature.

By 'polybasic amino compound' is meant a compound containing at least two groups selected from primary, secondary and tertiary amino groups (which may be in free base or protonated form) and quaternary ammonium groups. The polybasic compound may be reacted with the N-methylol compound (B) to form a precondensate, or a mixture of (A) and (B) may be used. Which of these alternatives is to be preferred will depend upon the particular compounds used, particularly on the compounds (A), but in general a reacted precondensate of (A) and (B) is preferred.

The method of the invention may be used in such a way that a direct or reactive dyestuff is selected such as will give an alkali-resistant precipitate with the polybasic amino compound (A) component of the aftertreatment agent which will be used. Alternatively an aftertreatment agent suitable for use with a given dyestuff may be selected by finding a polybasic amino compound (A) component which will give an alkali-resistant precipitate with that dyestuff.

Preferred compounds (A) include for example the reaction products (hereafter referred to as products III) of a monofunctional amine of formula I $$RRNH \qquad \text{I}$$

or a polyfunctional amine of formula II $$RRN\text{-}(Z\text{—}X)_n Z\text{—}NRR \qquad \text{II}$$

in which each

R independently is hydrogen or a $C_{1-11}$alkyl group unsubstituted or monosubstituted with hydroxy, $C_{1-4}$alkoxy or cyano, n is a number from 0 to 100

Z, or each Z independently when n>0, is $C_{1-4}$alkylene or hydroxyalkylene and X, or each X independently when n>1, is —O—, —S— or —NR— where R is as defined above, provided that the amine of formula II contains at least one reactive —NH— or —$NH_2$ group, with cyanamide, dicyanodiamide (DCDA) or guanidine.

More preferably, product III is the reaction product of a polyfunctional amine of formula II with cyanamide, DCDA or guanidine. In the amines of formula II, R is preferably hydrogen or $C_{1-4}$alkyl or hydroxyalkyl, more preferably each R is hydrogen. n is preferably a number from 0 to 30, which may be non-integral representing an average value. More preferably n is an integer from 1 to 6. Z is preferably a 1,2-ethylene, 1,3-propylene or 1,3-(2-hydroxypropylene) group, X is preferably —NR—, most preferably —NH—.

Particularly preferred amines are diethylene triamine, triethylene tetramine and higher polyethylene polyamines, polypropylene polyamines, or poly(hydroxypropylene)polyamines containing up to 8, preferably up to 6, N atoms.

In the reaction with cyanamide, DCDA, guanidine or biguanidine, the amines may be in free base or in salt form, for example in the carbonate form, and mixtures of amines may be used. Where ammonia is a reactant this is preferably used in the salt form. Preferred reagents are guanidine and DCDA, particularly DCDA and particularly preferred products III are the reaction products of diethylene triamine or triethylenetetramine with DCDA.

Products III are known, and their preparation is described for example in British Pat. No. 657 753 and in U.S. Pat. No. 2,649,354. Suitably the reagents are reacted together in the absence of water at elevated temperatures, optionally in the presence of a nonaqueous solvent. Preferably the reaction is carried out in the absence of solvent at a temperature of 140°-160° C., and where the reagent is an amine, ammonia is evolved. The reagents are preferably reacted in a molar ratio of 0.1 to 1 mole of cyanamide, DCDA, guanidine or biguanidine per mole of reactive —NH or —$NH_2$ groups, and when DCDA is reacted with a polyalkylene polyamine, the molar ratio of the reactants is more preferably from 2:1 to 1:2, particularly about 1:1.

Further preferred polybasic amino compounds (A) are the known reaction products of an amine of formula IV

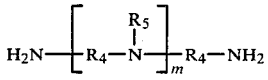

IV in which m is a number from 1 to 5, each $R_4$, independently, is a $C_{2-4}$alkylene group $R_5$, or each $R_5$ independently when m>1, is hydrogen or $C_{1-4}$alkyl unsubstituted or substituted by one OH, $C_{1-4}$alkoxy, halogen or phenyl group, with an epihalohydrin or dihalohydrin, preferably epichlorohydrin. The products (hereinafter referred to as compounds V) are high molecular weight water-soluble compounds with an average molecular weight between 1000 and 30 000, depending upon the condensation time and reaction conditions. Compounds V contain repeating units which for example when the amine of formula IV is N,N-bis(3-aminopropyl)methylamine are of the structure

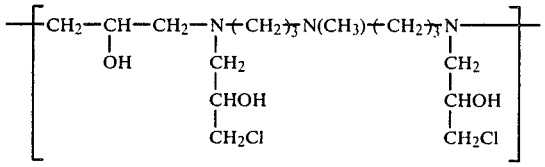

which is repeated approximately 3–20 times.

Preferred amines of formula IV are diethylene- or dipropylenetriamine, triethylene- or tripropylenetetramine, 3-(2-aminoethyl)aminopropylamine and N,N-bis-(3-aminopropyl)methylamine, particularly dipropylene triamine and N,N-bis-(3-aminopropyl)methylamine. The reaction product of 1 mole of the last-named amine with 3 moles of epichlorohydrin is particularly preferred as a compound V.

Compounds V are known for example from U.S. Pat. No. 2,595,935 and may be prepared as described therein. Preferably the compounds V are obtained in salt form, i.e. as acid addition salts with mineral or organic acids.

Further preferred polybasic amino compounds (A) are known polymeric quaternary ammonium compounds (hereafter referred to as compounds VI) containing the repeating unit VII

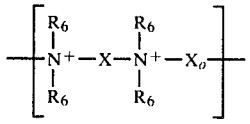

VII in which each $R_6$, independently, is unsubstituted or substituted alkyl, cycloalkyl, alkenyl or aryl having not more than 20 carbon atoms; or two $R_6$ groups attached to the same nitrogen atom, together with that nitrogen atom, form a 5- or 6-membered heterocyclic ring, which may bear further substituents;

X is a divalent bridging group of formula $—C_pH_{2p}—$ in which p is 2–12; or of formula $—Y_1—Z_o—Y_2—$ in which $Y_1$ and $Y_2$ independently are $—C_{p'}H_{2p'}—$ where p' is 1–12, provided that $Y_1$ and $Y_2$ are not both $—CH_2—$ and that where either $Y_1$ or $Y_2$ is $—CH_2—$ the bonding to group $Z_o$ may not be through an oxygen or nitrogen atom; or is phenylene unsubstituted or substituted by halogen, hydroxy, alkyl, haloalkyl or alkoxy;

$X_o$ is $—C_pH_{2p}$, $—CH_2—O—R_8—O—CH_2—$, $—CH_2(OR_9)_qOCH_2—$, $—CH_2COCH_2—$, $—CH_2CHOHCH_2—$,

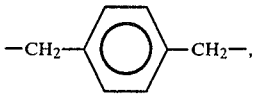

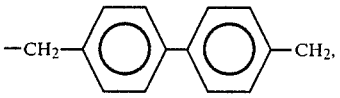

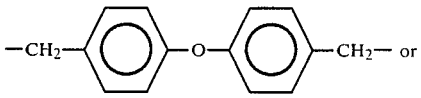

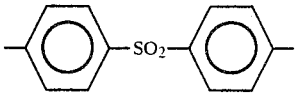

in which q is 2–15;

$R_8$ is a straight or branched chain $C_{2-12}$alkylene group, unsubstituted or substituted by halogen;

$R_9$ is $—CH_2CH_2—$, $—CH_2CH(CH_3)—$ or $-(CH_2)_4-$; and $Z_o$ is a group —NHCONH—,

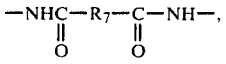

—CONH—, —OCONH—, —COO—, $—CO—R_{10}—CO—$,

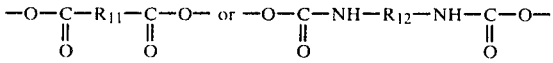

in which $R_7$ is a direct bond or an alkylene, alkenylene, arylene, diaminoalkylene, diaminoarylene, dioxyalkylene, polyoxyalkylene or dioxyarylene group;

$R_{10}$ is diaminoalkylene, dioxyalkylene, polyoxyalkylene or dithioalkylene;

$R_{11}$ is arylene and $R_{12}$ is alkylene or arylene.

Preferred compounds VI are those having, in repeating unit VII, groups $R_6$ which are, independently, $C_{5-6}$cycloalkyl; $C_{1-10}$alkyl unsubstituted or monosubstituted by hydroxy, cyano, alkoxy, alkylthio or alkylcarbonyl; $C_{1-4}$alkyl monosubstituted by arylsulphonyl or carboxylic acid groups, or mono- or di-substituted by $C_{1-4}$alkyl carboxylate groups; carboxyamidoalkyl having 1–10 carbon atoms in the alkyl part and optionally N-substituted with $C_{1-4}$alkyl, hydroxyalkyl or alkoxyalkyl, or aryl; phenyl or benzyl unsubstituted or substituted with hydroxy,cyano, halogen or carboxyl; or in which two groups $R_6$ attached to the same nitrogen atom form, together with that nitrogen atom, a 5- or 6-membered heterocyclic ring.

Particularly preferred compounds VI contain repeating units of formula VIIa

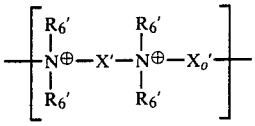

VIIa in which each $R_6'$, independently, is an alkyl, alkoxyalkyl or carboxyamidoalkyl group, X' is an alkylene, alkylene-NHCONH-alkylene or alkylene-NHCO-alkylene-CONH-alkylene group, and $X_o'$ is an alkylene, $—CH_2COCH_2—$, $—CH_2C_6H_4CH_2—$ or

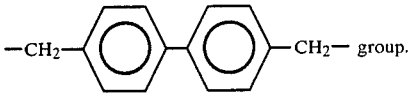

group.

Compounds VI are described in U.S. Pat. No. 4,247,476, and may be prepared by the methods described therein.

Suitable N-methylol compounds (B) and cross-linking catalysts (C) are described in U.S. Pat. No. 4,410,652 and corresponding British published patent application No. 2 070 006. In this specification, 'halogen' means chlorine or bromine, preferably chlorine.

The process of selecting a suitable aftertreatment agent for a given dyestuff or, alternatively, a suitable dyestuff for a given aftertreatment agent is carried out as follows: The polybasic amino compound (A), for example a compound III, V or VI, and the dyestuff, preferably in its commercial form, are brought into aqueous solution, suitably in a concentration range of 0.2–8% by weight. The two solutions are mixed together at room temperature, whereby the weight ratio of dyestuff to compound (A) is suitably in the range 1:0.5 to 1:10. Preferably an excess of compound (A) is used, the weight ratio of dyestuff to compound (A) being preferably 1:1.5 to 1:2.5.

A precipitate will in all cases be formed, which preferably will contain all of the dyestuff; that is, there should preferably be little or no dyestuff remaining in solution. The precipitate is isolated by filtration, washed with water until the washings are colourless, dried and finally added to dilute aqueous sodium hydroxide (at least pH 12). Preferably approx. 10 ml of sodium hydroxide solution is used per gram of precipitate. If the precipitate is stable, that is, no significant quantity of dyestuff or amino compound goes into solution, then the aftertreatment agent and dyestuff are compatible. Dyeings on cellulose with that dyestuff, subsequently treated with an aftertreatment agent based on that amino compound (A) will exhibit particularly good wet fastness properties. By varying one or the other component, the results can be obtimised and the ideal combination determined.

The test method of the invention may be carried out in practice either by the manufacturer of the dyestuffs and/or aftertreatment agents or by the user, i.e. the dyer. The manufacturer may use this method to select suitable combinations of dyes and aftertreatment agents from his range of market products, or to develop new compounds as required, and will pass on the appropriate recommendations to his customers. If the aftertreatment agent is a reaction product (precondensate) of A and B, then as a rule only the manufacturer will be in the position to select the amino compound (A). On the other hand if mixtures of (A) and (B) are used, then the dyer himself can select suitable dyestuffs for use with a given aftertreatment agent.

The dyeing or printing of the cellulose-containing substrate with a direct or reactive dye may be carried out by any conventional method. The dye may be applied by an exhaust process from a long or short bath, by printing or by padding, for example by the cold-dwell process.

The aftertreatment is carried out after normal fixation of the dyestuff. The substrate may be dried before aftertreatment, or may be treated in the damp state, provided that sufficient pick-up of the treatment solution takes place. The aftertreatment agent, i.e. the mixture or reaction product of (A) and (B) together with catalyst (C) can be applied to the substrate by known methods such as padding, dripping, spraying, dipping, foam application, etc., preferably at room temperature.

Fixation (crosslinking) of the aftertreatment agent takes place according to any of the known dry crosslinking processes. After application and squeezing a thermoshock process may be used in which drying and curing is carried out in a single operation at temperatures from 120°–200° C., particularly 130°–180° C. The substrate can also be dried at 70°–120° C. and finally cured at temperatures of 120°–200° C., preferably 140°–180° C., for 5 seconds to 8 minutes, preferably 30 seconds to 1 minute at 170°–180° C.

The quantity of aftertreatment agent to be used (whether as precondensate or as mixture) depends mainly upon the depth of the dyeing to be fixed. For example, for a 1/1 standard depth dyeing, a concentration of 30–200 g/l of the impregnation bath may be used, preferably 70–130 g/l for cotton and 100–200 g/l for regenerated cellulose, for a pick-up during impregnation of 70–100%, based on dry substrate weight.

Not only dyeings on cellulosic fibres such as cotton and viscose but also those on mixtures of these with synthetic fibres may be treated. For mixed substrates the quantity of aftertreatment agent used in based on the amount of cellulose fibres present.

Preferred dyeings for treatment are those made with direct dyes, particularly those of the metal complex series, especially copper complexes of direct dyestuffs, or direct dyestuffs which can be converted on the fibre to copper complexes. The following list exemplifies particularly suitable dyestuffs, but the invention is not limited to these.

VIII
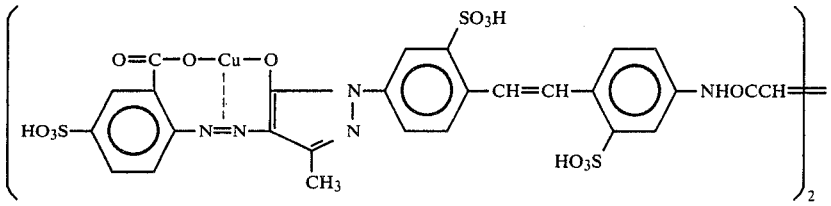
IX
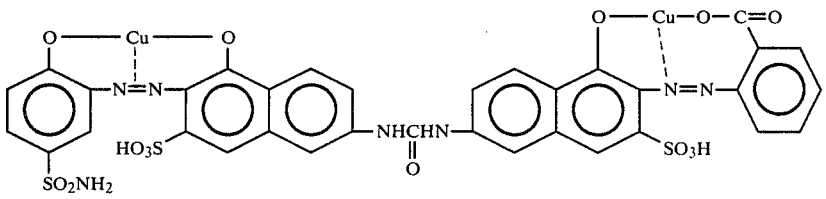
X
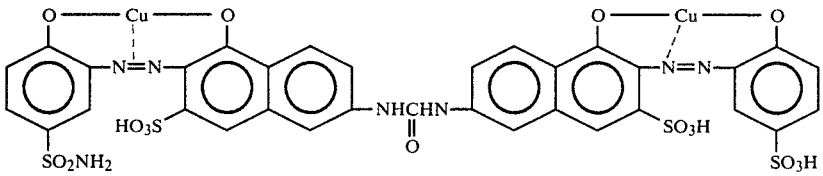
XI
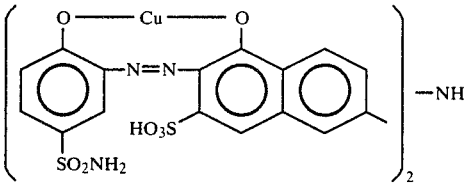
XII
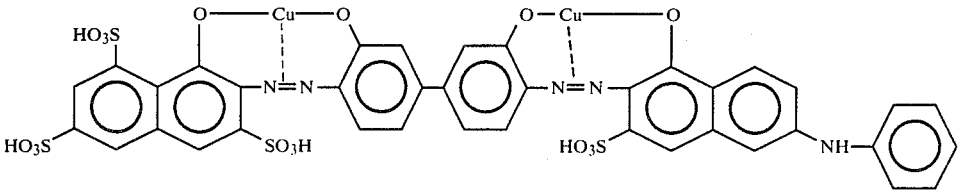
XIII
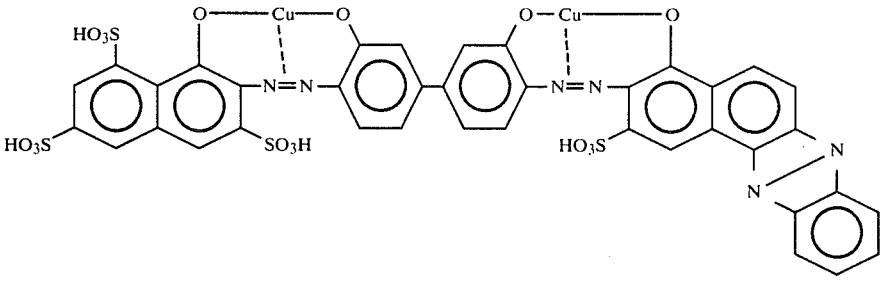
XIV
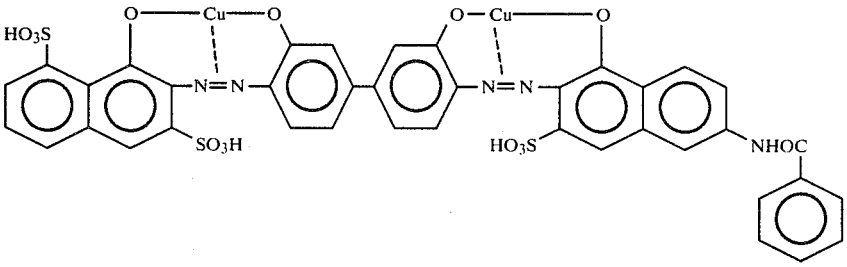

-continued
XV
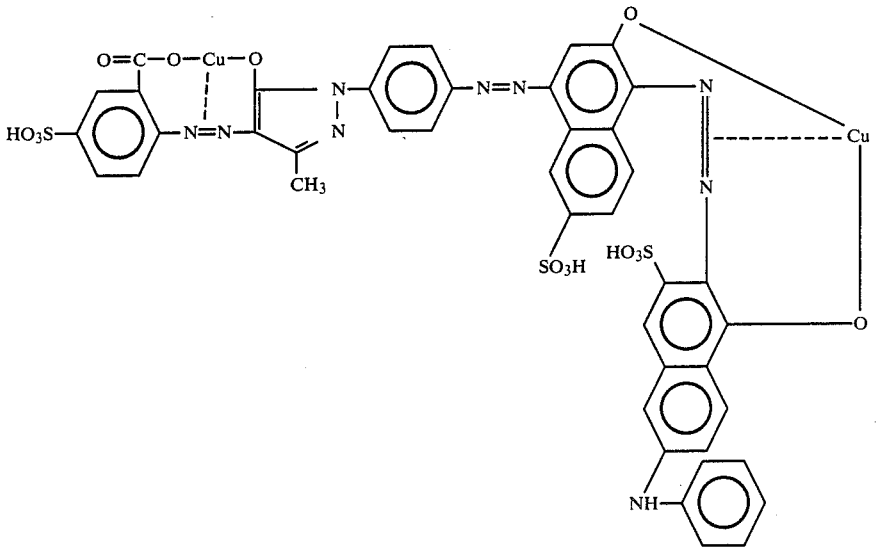
XVI
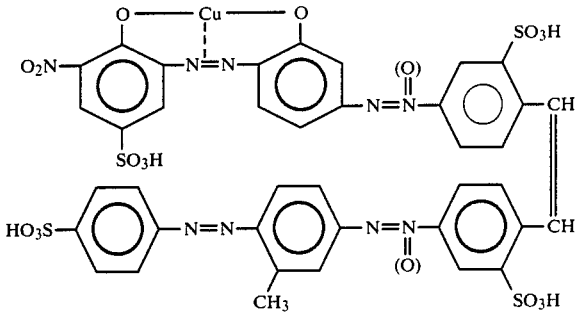
XVII
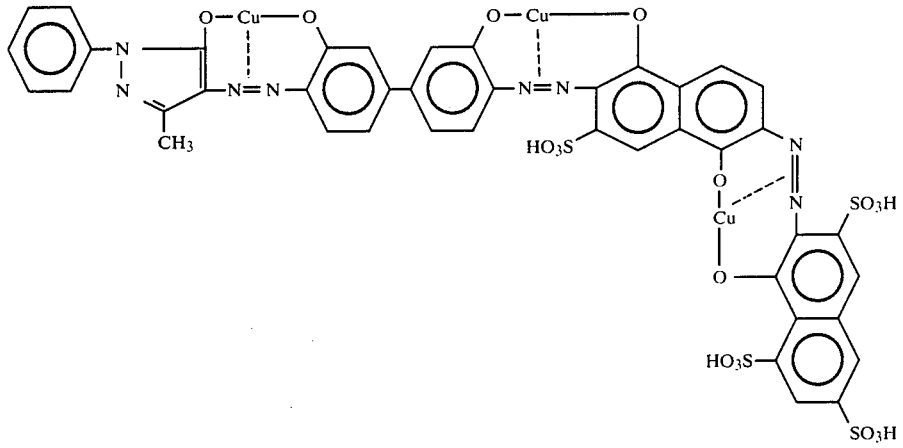
XVIII
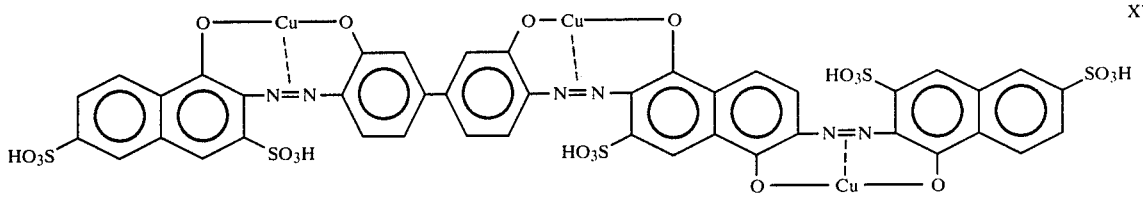

-continued

XVIV

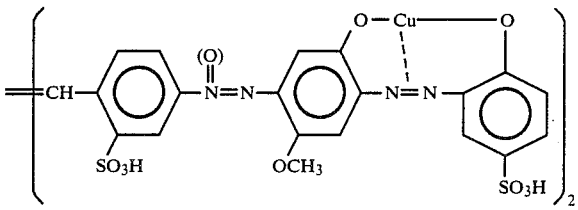

XX

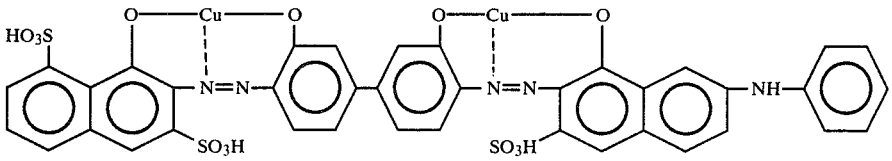

XXI

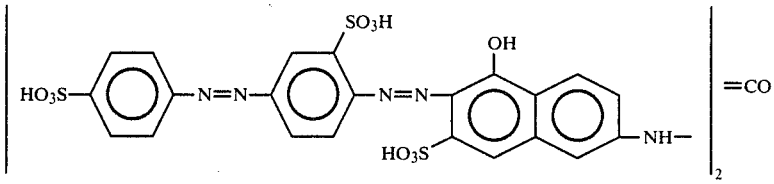

XXII

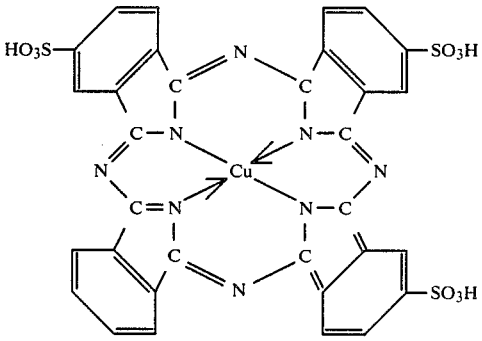

CI Direct Violet 66, CI Direct Red 80, CI Direct Yellow 50, CI Direct Yellow 39, CI Direct Yellow 98, CI Direct Red 83, CI Direct Red 95, CI Direct Red 207, CI Direct Violet 47, CI Direct Blue 77, CI Direct Blue 90, CI Direct Blue 251, CI Direct Green 27, CI Direct Green 31, CI Direct Green 65, CI Direct Green 67, CI Direct Brown 103, CI Direct Brown 111, CI Direct Brown 113, CI Direct Brown 200, CI Direct Black 62, CI Direct Black 117, CI Direct Black 118, CI Direct Blue 79, CI Direct Blue 217, CI Reactive Violet 23.CI Reactive Blue 23, CI Reactive Blue 79.

The improved wet fastness properties obtained by the process of the invention are also resistant to repeated washing under alkaline conditions even at temperatures of 60°-80° C. Wash liquors (at 1:50 goods:liquor ratio) with for example 5 g/l soap and 2 g/l calcined washing soda, and repeated 30 minute washes are withstood without difficulty. The dyeings are alo characterised by good light fastness.

At the same time a cross-linking (crease-resistant finishing) of the cellulose fibres is obtained, which causes reduced swelling in aqueous and alkaline solutions. As a result drying is faster, dimensional stability is improved and crease-resistant properties are obtained.

The following Examples, in which all parts quoted for aqueous solutions are parts by volume and all other parts are parts by weight; percentages are by weight and temperatures are in degrees Centigrade, illustrate the invention.

EXAMPLE 1

(a) 103 Parts diethylene triamine and 84 parts DCDA are heated slowly to 100°-110°. Ammonia is given off and the temperature rises to 160°. After no more ammonia is evolved, the mixture is held at 160° for 6 hours. The resulting mass is neutralised with dilute sulphuric acid under cooling, and finally spray-dried.

(b) 20 Parts of this reaction product are dissolved in 1000 parts water and to this solution is added 10 parts of the dyestuff of formula XIII, dissolved in 500 parts water. The resulting precipitate is filtered, washed and dried. 1 Part of this precipitate is suspended in 10 parts dilute NaOH (pH 12), and shaken for several minutes at room temperature. The precipitate does not dissolve and the supernatant liquid obtained by centrifuging the precipitate remains practically colourless.

(c) 25 Parts of the neutralised product of Example 1(*a*) are mixed with 15 parts magnesium chloride hexahydrate and 100 parts of a 50% aqueous solution of dimethyloldihydroxyethyleneurea, and allowed to react for 1 hour at 70°. A cloudy water-soluble liquid is obtained, which can be used as aftertreatment agent without further purification.

(d) A cotton dyeing with the dyestuff of formula XIII (1/1 standard depth) is padded with a solution containing 130 g/l of the product of Example 1(*c*), and squeezed out to a pick-up of approximately 80%. The goods are then given a thermoshock treatment on a tension frame at 175°–180° such that the heat treatment is continued for approx. 30–45 seconds after the initial drying of the goods.

The fixed dyeing is characterised by a high wash fastness which is retained through repeated 60° washings and will even withstand washing at the boil. At the same time a clear improvement in crease resistance and reduced wet swelling of the cellulose fibres is obtained.

(e) A cotton dyeing as in Example 1(*d*) is padded with a mixture of the product of Example 1(*a*) (50 parts), dimethyloldihydroxyethyleneurea (100 parts of a 50% aqueous solution) and magnesium chloride hexahydrate (15 parts), and squeezed to approx. an 80% pickup. The goods are shock-dried and cured as in Example 1(*d*), and improved wet fastness properties are obtained.

EXAMPLE 2

(a) 175.5 Parts 3-(2-aminoethyl)-aminopropylamine are reacted with 84 parts DCDA for 6 hours at 120°, approx. 33 parts of ammonia being evolved. The condensation product is finally diluted with 227 parts water and neutralised with dilute sulphuric acid.

(b) The product of Example 2(*a*) (in excess) is treated with a 3% aqueous solution of the dyestuff of formula XIV. The resulting precipitate is stable in dilute caustic soda.

(c) A dyeing on cotton with the dyestuff of formula XIV may be improved in wet fastness properties by aftertreatment as in Example 1(*d*) with a reaction product or mixture based on the product of Example 2(*a*), made as described in Example 1(*c*) or 1(*e*).

EXAMPLE 3

(a) 120 Parts ethylene diamine and 84 parts DCDA are reacted for 6 hours at 115°, 34 parts of ammonia being evolved. The condensation product is diluted with 170 parts water and neutralised.

(b) An excess of the product of Example 3(*a*) is treated with a 3% aqueous solution of the dyestuff of formula XIV. The resulting precipitate is stable in dilute aqueous caustic soda.

(c) By proceeding as in Example 1(*c*)–(*e*), but using the product of Example 3(*a*) as starting material, cotton dyeings of the dyestuff of formula XIV having improved wet fastness properties may be obtained.

EXAMPLES 4–10

Polybasic amino compounds (A) are obtained by reacting together in known manner the following starting materials:

(4) 3 moles epichlorohydrin with 1 mole dipropylenetriamine
(5) 92 parts dichlorohydrin with 46 parts dipropylenetriamine
(6) 92 parts epichlorohydrin with 36 parts diethylenetriamine
(7) 92 parts epichlorohydrin with 50 parts N,N-bis-(3-aminopropyl)methylamine
(8) 92 parts epichlorohydrin with 41 parts 3-(2-aminoethyl)-aminopropylamine
(9) 227 parts epichlorohydrin with 159 parts N,N-bis-(3-aminopropyl)-ethylamine
(10) 92 parts epichlorohydrin with 36 parts di(aminoethyl)-methylamine.

These compounds give alkali-stable precipitates with the dyestuffs of formula VIII–XXII, and reaction products or mixtures of these compounds with dimethyloldihydroxyethyleneurea and magnesium chloride may be used as aftertreatment agents to increase the wet fastness of dyeings of these dyestuffs on cotton.

EXAMPLE 11

Equimolar (0.2 mole) quantities of p,p'-bis(chloromethyl)biphenyl and 1,3-bis-(3-dimethylaminopropyl)urea (prepared from 1-dimethylamino-3-aminopropane and urea with elimination of ammonia) are heated together in 200 ml methanol at reflux for 24 hours. During the reaction the viscosity of the solution increases. The product is cooled and the solvent removed in vacuo to give a quantitative yield of a polymer having the repeating unit:

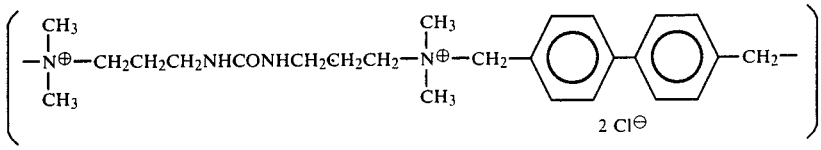

EXAMPLES 12–23

Polymeric polyquaternary compounds (A) may be prepared by reaction as in Example 11 of the following starting materials:

EXAMPLE 12

1 mole 1,3-bis-(3-dimethylaminopropyl)urea with 1 mole

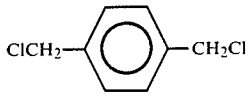

EXAMPLE 13

1 mole 1,3-bis(3-dimethylaminopropyl)urea with 1 mole $ClCH_2COCH_2Cl$

EXAMPLE 14

1 mole 1,3-bis-(3-dimethylaminopropyl)urea with 1 mole $Br(CH_2)_{10}Br$

EXAMPLE 15

1 mole 1,3-bis-(3-dimethylaminopropyl)urea with 1 mole $Br(CH_2)_6Br$

EXAMPLE 16

1 mole 1,3-bis(3-dimethylaminoethyl)urea with 1 mole p,p'-bis-(chloromethyl)biphenyl

EXAMPLE 17

1 mole $(CH_3)_2N(CH_2)_3NHCO(CH_2)_4COHN(CH_2)_3N(CH_3)_2$ (prepared from diethyl adipate and 1-dimethylamino-3-aminopropane) with 1 mole $Br(CH_2)_6Br$

EXAMPLE 18

2 moles p,p'-bis-(chloromethyl)biphenyl with 1 mole tetramethylethylenediamine and 1 mole 1,3-bis-(3-dimethylaminopropyl)urea

EXAMPLE 19

2 moles p,p'-bis-(chloromethyl)biphenyl with 1 mole tetramethylhexylenediamine and 1 mole 1,3-bis-(3-dimethylaminopropyl)urea

EXAMPLE 20

1 mole p,p'-bis-(chloromethyl)biphenyl with 1 mole $Br(CH_2)_6Br$ and 2 moles 1,3-bis-(3-dimethylaminopropyl)urea

EXAMPLE 21

2 moles p,p'-bis-(chloromethyl)biphenyl with 1 mole 1,3-bis-(3-dimethylaminopropyl)urea and 1 mole $(CH_3)_2N(CH_2)_3N(CH_2CH_2CONH_2)_2$ (prepared from acrylamide and 3-dimethylamino-1-aminopropane)

EXAMPLE 22

The product of Example 21, further methylolated with formaldehyde

EXAMPLE 23

1 mole p,p'-bis-(chloromethyl)biphenyl with 1 mole $Br(CH_2)_6Br$, 1 mole tetramethylpropylenediamine and 1 mole 1,3-bis-(3-bis-(3-dimethylaminopropyl)urea The products of Examples 12—23 give with dyestuffs VIII–XXII, and with the C.I. dyestuffs listed after dyestuff XXII, precipitates which are stable to dilute aqueous alkali. Mixtures or reaction products of these polymers with N-methylol compounds B may be used to fix dyeings of these dyestuffs on cellulose, giving improved wet fastness properties.

We claim:

1. A method for determining the combined suitability of a direct or reactive dyestuff and a polybasic amino compound for use in dyeing or printing a cellulosic substrate and in the preparation of an aftertreatment agent for improving the wetfastness of the resulting dyeing or printing, said method comprising the steps of (A) mixing an aqueous solution of said direct or reactive dyestuff with an aqueous solution of said polybasic amino compound to form a precipitate;

(B) introducing the precipitate from step (A) into an aqueous alkali solution having a pH≧12 at room temperature, and (C) observing whether the precipitate introduced in step (B) dissolves in the aqueous alkali solution, said combination being suitable if the precipitate does not dissolve in said aqueous alkali solution.

2. A method according to claim 1 wherein step (A) is carried out at room temperature.

3. A method according to claim 1 wherein the aqueous solutions mixed in Step (A) have a concentration of dyestuff and polybasic amino compound, respectively, in the range 0.2 to 8% by weight and said solutions are mixed together in such proportions as to give a weight ratio of the dyestuff to the polybasic amino compound in the range 1:0.5 to 1:10.

4. A method according to claim 3 wherein, in step (B), the aqueous alkali solution is present in an amount of about 10 ml. per gram of precipitate.

5. A method according to claim 1 which includes the steps of isolating the precipitate from step (A) and washing it with water prior to carrying out step (B).

6. A method according to claim 5 wherein the washing is carried out until the washings are colorless.

7. A method according to claim 5 which includes the further step of drying the washed precipitate prior to carrying out step (B).

8. A method according to claim 7 in which an aftertreatment agent is the product of a chemical reaction of a polybasic amino compound with an N-methylol compound or with formaldehyde or a formaldehyde donor.

9. A method according to claim 5 wherein step (A) is carried out at room temperature.

10. A method according to claim 9 which includes the further step of drying the washed precipitate prior to carrying out step (B).

11. A method according to claim 9 wherein, in step (B), the aqueous alkali solution is present in an amount of about 10 ml. per gram of precipitate.

12. A method according to claim 9 wherein the washing is carried out until the washings are colorless.

13. A method according to claim 9 wherein the aqueous solutions mixed in step (A) have a concentration of dyestuff and polybasic amino compound, respectively, in the range 0.2 to 8% by weight and said solutions are mixed together in such proportions as to give a weight ratio of the dyestuff to the polybasic amino compound in the range 1:0.5 to 1:10.

14. A method according to claim 13 wherein the weight ratio of the dyestuff to the polybasic amino compound is in the range 1:1.5 to 1:2.5.

15. A method of selecting a combination of a direct or reactive dyestuff and a polybasic amino compound for use in dyeing or printing a cellulosic substrate and in the preparation of an aftertreatment agent for improving the wetfastness of the resulting dyeing or printing, said method comprising the steps of (A) mixing an aqueous solution of a direct or reactive dyestuff with an aqueous solution of a polybasic amino compound to form a precipitate, (B) introducing the precipitate from step (A) into an aqueous alkali solution having a pH≧12 at room temperature, (C) observing whether the precipitate introduced in step (B) dissolves in the aqueous alkali solution, (D) repeating steps (A), (B) and (C), with one or more different combinations of a direct or reactive dyestuff and a polybasic amino compound, and (E) selecting, for use in a process of dyeing or printing a cellulosic substrate and preparing an after treatment agent for improving the wetfastness of the resulting dying or printing, a combination of a direct or reactive dyestuff and a polybasic amino compound which, when treated according to steps (A) to (C), forms a precipitate which does not dissolve in the aqueous alkali solution.

16. A method according to claim 15 wherein step (A) is carried out at room temperature.

17. A method according to claim 15 for selecting a direct or reactive dyestuff for use in combination with a given polybasic amino compound wherein step (D) comprises repeating steps A, (B) and (C) with one or more different combinations of a direct or reactive dyestuff and said given polybasic amino compound.

18. A method according to claim 15 for selecting a polybasic amino compound for use in combination with a given direct or reactive dyestuff wherein step (D) comprises repeating steps (A), (B) and (C) with one or more different combinations of said given direct or reactive dyestuff and a polybasic amino compound.

* * * * *